United States Patent [19]

Flora

[11] 4,167,714

[45] Sep. 11, 1979

[54] CONSTANT IMPEDANCE TRANSMISSION LINE ROUTING NETWORK

[75] Inventor: Laurence P. Flora, Covina, Calif.

[73] Assignee: Burroughs Corporation, Detroit, Mich.

[21] Appl. No.: 888,423

[22] Filed: Mar. 20, 1978

[51] Int. Cl.[2] ..... H01P 1/12

[52] U.S. Cl. ..... 333/101; 333/105

[58] Field of Search ..... 333/101, 105

[56] References Cited

U.S. PATENT DOCUMENTS

| | | | |
|---|---|---|---|
| 3,829,801 | 8/1974 | Priestly et al. | 333/101 |
| 4,044,319 | 8/1977 | Seinecke | 333/101 |
| 4,044,320 | 8/1977 | Seinecke | 333/101 |

*Primary Examiner*—Alfred E. Smith
*Assistant Examiner*—Robert E. Wise
*Attorney, Agent, or Firm*—Alfred W. Kozak; Nathan Cass; Kevin R. Peterson

[57] ABSTRACT

A network apparatus whereby a high frequency transmission line may be switched and distributed to any one of a selected number of outputs without disturbing the characteristic impedance or continuity of the transmission line. Transmission strip lines on a printed circuit board connect each of the two outputs of a single pole double-throw reed relay to the single input of a subsequent double-throw relay. The relay switches and the transmission strip lines are parallel to an embedded ground plane within the printed circuit board. Each realy switch is surrounded by an electromagnetic shield which is connected at both its input end and its output end to the ground plane in the most direct fashion. Actuating means are provided proximate to each relay switch for activation purposes. Thus, a switching tree network may be provided whereby the single input line suitable for carrying high frequency signals, including digital signals having high rate rise times and high rate fall times, may be distributed to the relay switching tree to a selected single output of a plurality of outputs without changing the characteristic impedance of the transmission line.

12 Claims, 6 Drawing Figures

Fig. 1
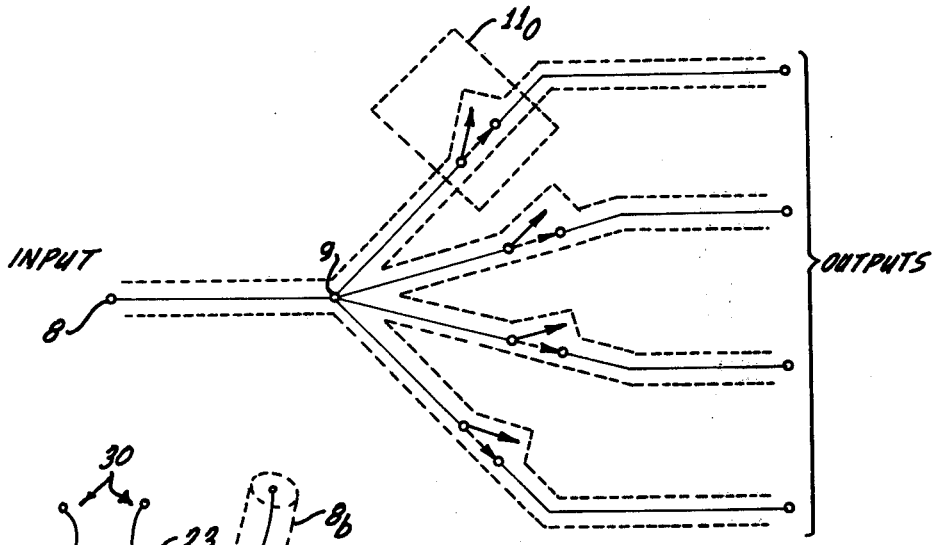
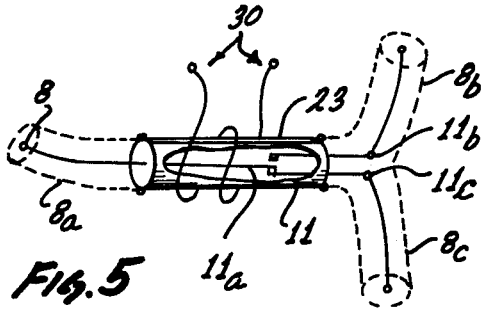
Fig. 5
Fig. 2
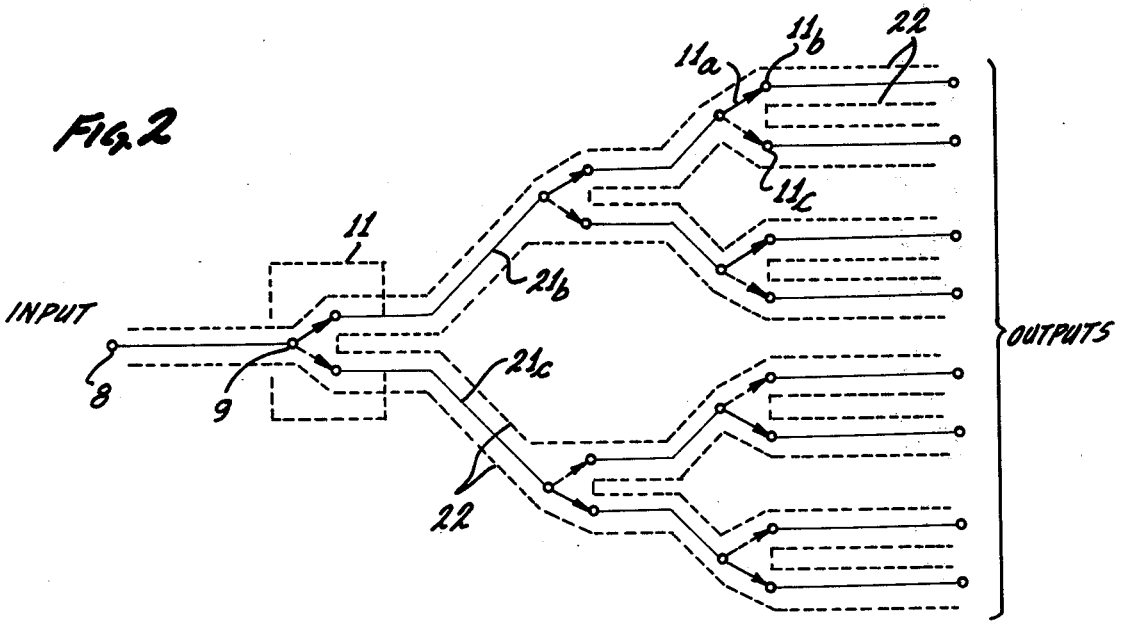

CONSTANT IMPEDANCE TRANSMISSION LINE ROUTING NETWORK

FIELD OF THE INVENTION

This invention relates to distribution networks and the use of relays to provide a plurality of transmission line paths in which each possible path routing does not differ in impedance from any other path routing, and in which there are no impedance discontinuities.

BACKGROUND OF THE INVENTION

With the use of digital signals, squarewave signals and a multitude of other variety of high frequency signals, it is often necessary that a transmission line maintain a uniform impedance characteristic in order that digital signals or high frequency signals transmitted along the line are not distorted, reflected or altered in phase when the transmission line is carrying or conveying the signals. Certain digital data processing systems, data communications systems, testing systems and other switching systems using high frequency signals require that the input end of a transmission line be routed over to a variety of other output terminals after being switched through different paths.

In order to keep the disturbance to the line as small as possible, this requires a switching system with a controlled impedance matching the impedance of the transmission line and maintaining the constant impedance no matter how many switches are in the line. Generally, these types of transmission line systems are designed to have a characteristic impedance somewhere between 50–100 ohms, which theoretically remains constant at the designed impedance; however, any changes in length or routing may lead to problems in high frequency switching systems if the impedance-constancy of the transmission line is not maintained.

One place in the digital processing field where the problem of line variance arises is in the testing of high speed integrated circuits. In this situation, pulses with fast edges rates (high-speed rise-time and fall-time) are used. These types of pulses contain a wide range of frequencies which complicates the problem of switching the signal through various other transmission lines without introducing distortion to the signal pulses.

The problem of maintaining a constant impedance transmission line and still permitting switching of the line into different output paths has heretofore been handled by the use of so called "coaxial relays" which are precisionally built and extremely expensive in cost per unit. These coaxial relays can switch an input signal to one of two (sometimes more) outputs. These generally are well designed and introduce very little distortion to the input signal travelling through.

Generally, when switching systems have to be applied to computer applications, such as the testing of high speed integrated circuits, these may involve the connecting of hundreds of terminals to be tested. Since a multitude of coaxial relays are required, the cost of building a test system using these coaxial relays becomes prohibitive. For example, a test system (which may routinely need to switch an input signal to one of 50 available output terminal lines) would require such a multitutde of coaxial relays, to do the job properly, that it would make this application unreasonably expensive. Thus, commercial systems which would require the use of this type of switching with coaxial relays find that it is prohibitive.

A number of manufacturers have attempted to handle this problem in the fashion shown in FIG. 1 by connecting many small single throw relays $\mathbf{11}_o$ to one point and closing only one relay at a given time. Generally, these relays are the small inexpensive reed relay types. However, a persistent problem that arises with this solution, as seen in FIG. 1, is that each relay connected to a common node 9 will form a stub and add a capacitative load or discontinuity. For example, in FIG. 1, while one relay is closed, there are three other open relays hanging on or connected to the common node 9 which introduced a set of stubs making a capacitative load. In FIG. 1, for example, if the transmission system is designed as a 50 ohm system, which is customary in IC test systems, each relay is made as a "50 ohm" relay. This means that such a closed relay will behave electrically as if it were a piece of 50 ohm transmission line. However, each "open" relay connected to the node 9 behaves as a short stub. Thus, the only way to reduce the amount of load capacitance at that node is either to reduce the size of the relay or to reduce the number of relays, which again tends to defeat the problem of switching a transmission line. This cluster-of-relays approach in FIG. 1 can never be a truly controlled-impedance system.

The practical answer to the problem is provided by the use of small inexpensive single-pole double-throw reed-type relays which can be placed on or embedded in a printed circuit board. The preferred apparatus described herein uses a single-pole double-throw reed relay which has one input and two output lines and does not have an off position. The input line is always connected either to one or the other of the two output lines. This should be contrasted with the "single throw" type relays which have one "off" position and one "on" position only. One typical type of the preferred reed relay is designated as a Form C Reed Relay as manufactured by Hamlin, Inc., Lake and Grove Streets, Lake Mills, Wis. 53551. Another similar type of such relays are the miniature mercury-wetted relays known as Logcells such as manufactured by Fifth Dimension, Inc., Post Office Box 483, Princeton, N.J. 08540.

SUMMARY OF THE INVENTION

The problems of providing a constant-impedance transmission line, which can be switched and routed to different destinations without altering the constant-impedance, do not have to be denied of practical use because of impossibly-expensive components such as coaxial switches or other devices.

A use of simple inexpensive double-throw reed-relays may be combined with high frequency transmission lines placed on a printed circuit board having a ground plane providing a "low side" or a common ground. Each switch means is electromagnetically shielded by an encompassing cover which is also grounded to the ground plane at each end of the shield. Further, each switch means may be encompassed by an actuating coil or by adjacent magnetic poles for actuation of the switch means. The switches have one input signal line and two output signal lines. Each one of the outputs of the initial relay switch then is connected by transmission strip lines of equal length and character to the inputs of two subsequent relay switches which then provide four output signal lines. Thus, no matter which routing is switched on by the relay switches, there is no change in the characteristic impedance at the transmission line and hence no distortion of high frequency signals. Whatever the desired impedance value of the transmission line, each relay switch is designed to match this impedance and all relay switches in a system are duplicates of each other and in impedance value of the transmission line.

DESCRIPTION OF THE DRAWINGS

FIG. 1 shows one type of switching system used in the art for high frequency transmission lines.

FIG. 2 is a schematic drawing showing an improved system for switching and routing constant-impedance transmission lines.

FIG. 5 is a drawing illustrating one simplified embodiment of the switching network.

DESCRIPTION OF PREFERRED EMBODIMENT

Figure 3A:
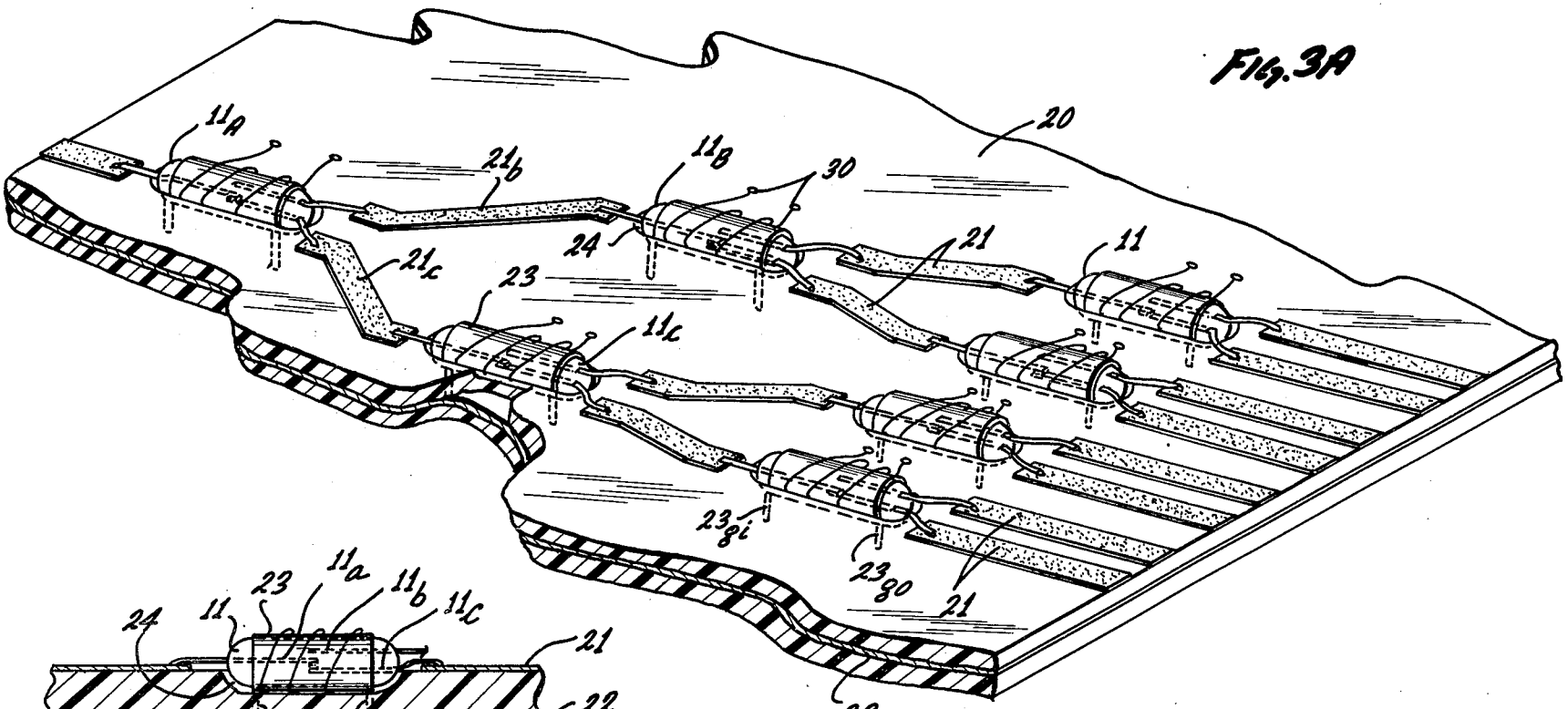
FIG. 3A and FIG. 3B show a specific practical embodiment of a switching system for a constant-impedance transmission line.

As seen in FIGS. 2 and 3A, a switchable transmission line providing continual constant impedance without the need for expensive coaxial relays may be seen. For example, reed relay switches in single-pole, double-throw versions may be chosen for the proper size of inner conductor and the proper size of the outer glass tube to provide a true controlled-impedance, single-pole, double-throw coaxial relay switch which are negligibly expensive in comparison to other devices such as the precision "coaxial type" relays. These inexpensive reed relay switches 11 may be connected in a tree structure as shown in FIG. 2 such that one signal can be routed to any number of destinations with no alteration or interruption of the characteristic impedance (or other desired impedance) of the transmission line system. There are no open stubs caused by open relays hanging on the line, as there are in FIG. 1.

The relay switches, FIG. 3A, may consist of an inexpensive readily available reed relay which is surrounded by conductive shield 23 having ground connections $23_{gi}$ and $23_{go}$ directly to ground plane 22. The actuating coil 30 can be wound directly on the shield or on a separate pole piece placed in close proximity to the reed relay.

In FIG. 1, which illustrates one version of the prior art, it will be seen that the relay switches 11 are single-pole single throw in which there is normally no connection until the relay is actuated at which time a closed connection is made. The relays 11 of FIG. 2 are to be contrasted in that they are single-pole double-throw relays in which, whether energized or not, there is always a connection between the input and one of the output lines.

As seen in FIG. 3A these inexpensive sealed relays may be mounted on a printed circuit board 20 and connected to strip lines or transmission lines 21 embedded in the printed circuit boards.

Figure 3B:
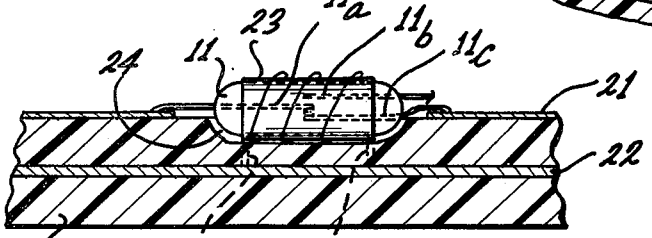

Referring to FIG. 3A and FIG. 3B there is seen a printed circuit board 20 having a ground plane 22 connected to each shield 23. Within the surface of the printed circuit board there are recessed indentations or grooves 24 into which may be placed a series of relay switches 11.

Each relay switch 11 is enclosed within a shield 23 which may be a copper mesh shield connected onto the ground plane 22.

Referring to FIG. 3A the electromagnetic shield 23 which encompasses each of the reed relay (single-pole, double-throw) switches is connected to the ground plane 22 at two separate and distinct locations. The input side of the shield has a ground connection $23_{gi}$ directly to the ground plane 22 while the output side of the shield 23 has a similar direct to ground connection shown at $23_{go}$. As can be seen in FIG. 3B these connections from the shield to ground are provided at either extremity of the shield by means of the direct-line connections $23_{gi}$ and $23_{go}$ which connect directly to the ground plane 22. It may be noted that the ground plane 22 is the "low" side of the transmission line and it is not necessary that this side be connected to an external earth ground.

Each relay switch 11 may be encompassed by an actuating winding 30 which is used to activate and change the internal contacts of the relay switch 11.

As seen in FIG. 3B, the inner mechanism of relay switch 11 may consist of a pair of stationary arms $11_b$, $11_c$ between which there may move a movable arm $11_a$. Thus, depending on non-energization of the winding 30, the arm $11_a$ will maintain contact with its normally closed arm $11_c$ or, upon energization of the coil 30, the movable arm $11_a$ will make contact with the arm $11_b$.

The arms $11_b$, $11_c$ are connected to transmission line strips 21 which are arranged on the surface of the printed circuit board 20. These transmission line strips, FIG. 3A, are symmetrically balanced in physical and electrical characteristics in their connective pattern between any two hierarchies of relay switches. Thus, a "zero level" relay switch $11_A$ has two output transmission line strips $21_b$ and $21_c$ which are symmetrically balanced to connect to a "first level" of relay switches $11_B$ and $11_C$.

The embodiment of FIG. 3A may be schematically illustrated in FIG. 2 wherein a single input transmission line may be switched and routed onto a multiple number of selected paths depending on the relay switching at each node such that a continuous transmission line will occur from input terminal to output terminal and will maintain a constant impedance without any capacitive stubs or other distorting factors hanging on to the transmission line which might alter the impedance and change the character of high frequency signals which are transmitted.

Figure 4:
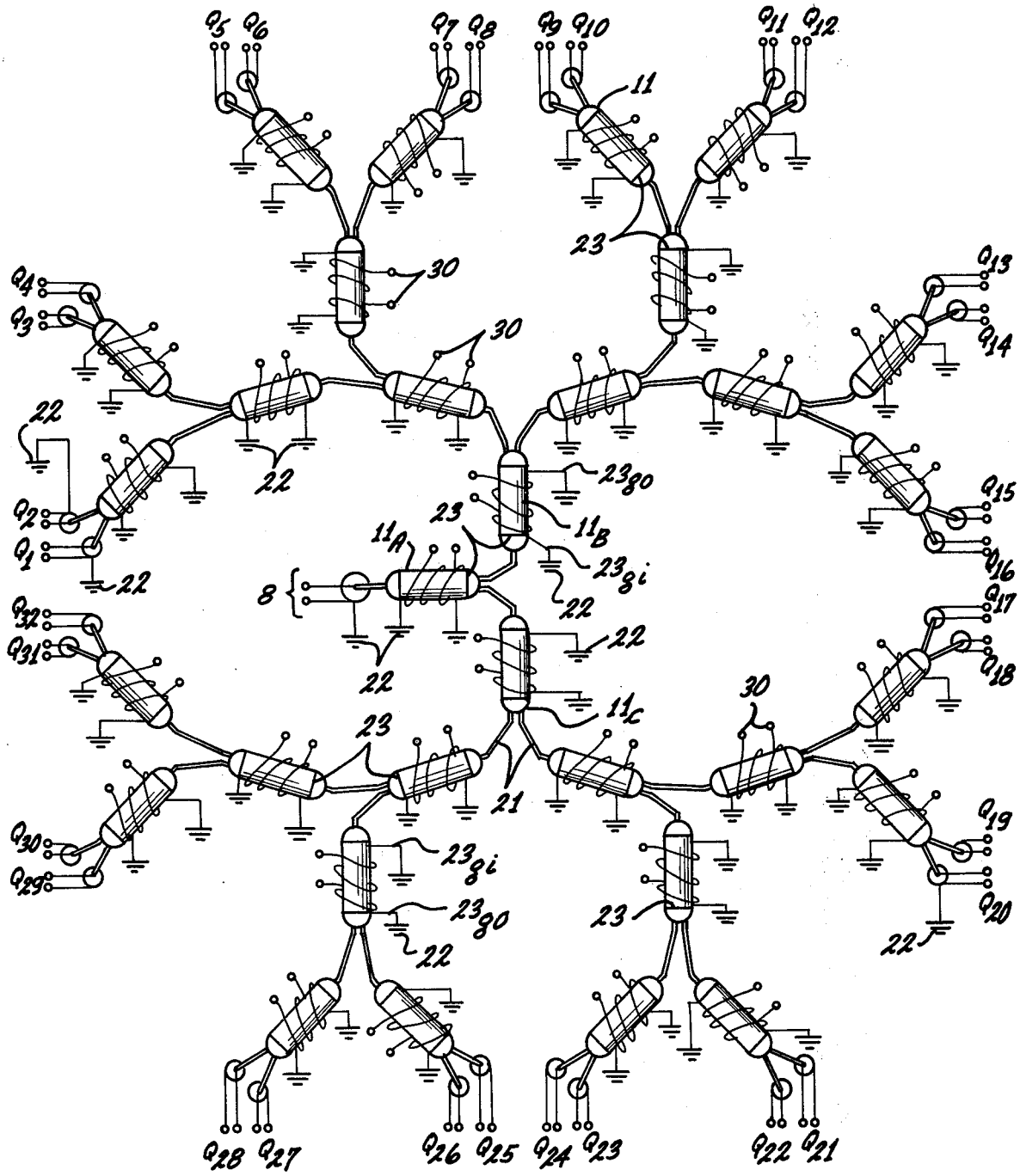
FIG. 4 is a schematic drawing showing one configuration of a high frequency transmission which is routable to any one of a large number of output signal lines.

Referring to FIG. 4, the input transmission line 8 to the apparatus may be a coaxial line having a center lead which is connected to the input line of the first relay switch 11A. The other side of the input coaxial line which is designated as the "low" or ground side is connected to the ground plane 22 (FIG. 3A).

Referring to FIG. 4, there is seen another preferred embodiment wherein an input signal line 8 is connected to a single-pole double-throw relay switch 11. Each output arm of the first relay switch $11_A$ connects to a second stage where two relay switches $11_B$, $11_C$ can connect the signal transmission line in one direction or the other. For example, a printed circuit board, such as 20 of FIG. 3A, would support and mount the configuration shown in FIG. 4. Each relay is shielded by shield 23 which is connected to ground plane 22. Likewise each relay can be actuated by a winding 30.

Thus, the input signal 8 may be connected to any one of 32 output lines as shown by $Q_1$, $Q_2$, $Q_3 \ldots Q_{30}$, $Q_{31}$, $Q_{32}$. In each case the transmission line from input 8 to any given output such as $Q_{30}$ will establish a constant impedance transmission line which has no capacitive stubs or other distortion making characters, thus permitting a true and accurate transmission of the input signal at 8. Each relay switch 11 is, of course, made to match the impedances of the transmission line and each relay switch in the system will have the same impedance characteristic. Likewise, each strip transmission line 21 will be balanced (at the output side of each relay switch 11) to maintain the proper characteristic impedance.

Referring to FIG. 5 another simplified embodiment of a high frequency transmission line system may be provided which is supported completely by coaxial cable and electromagnetic shields. The switching devices 11 may be effectively integrated onto a coaxial cable by continuously connecting the coaxial cable 8 to the shield 23 which encompasses the switching means 11. Thus, the input line coaxial cable $8_a$ has its outer "low" side or "ground" side connected to the input side of the electromagnetic shield 23. The output side of shield 23 is connected to the low side of cables $8_b$, $8_c$. The input conductor 8 connects to the input single pole $11_a$ of the switch 11. The output contacts $11_b$, $11_c$ are connected to a first and second coaxial cable $8_b$, $8_c$ wherein both of these coaxial cables are connected together on the low side to the shield 23 and also to each other.

Likewise, each cable $8_b$ and $8_c$ may have a reed relay switch integrated within it to branch out again into two more coaxial cables. In this case, the coaxial lines and switch-shields form a continuously integrated transmission line which branches out to form other integrated transmission lines of like nature whereby activation of selected coils 30 can be used to form a desired routing for high frequency signals without distortion.

Since the use of the reed relay switch in this combination permits the elimination of expensive precision switches, then the cost per relay-switch is reduced by approximately one-hundred fold and this one-hundred fold cost reduction is multiplied by the total number of relays used in the system, thus making it practically feasible to use and provide a distortion free transmission line which is switchable to a multitude of output terminals.

In order to provide a particular or selected path from input to output, it may be noted that each level of the switching tree could be considered to be a "binary bit" where a "one" indicates that the corresponding level is "actuated" (away from its normal position). This makes the structure most readily adaptable to computer control, that is to say, whereby binary signals can be used to actuate any given pattern of relays in the system of FIG. 4 in order to provide a distortion free constant impedance transmission path between the input 8 and any one of the selected outputs such as $Q_1$, $Q_2$, etc. Switching of relay trees is known in the art and is described in the AIEE Transactions, on page 582, Vol. 68, 1949 in an article by S. H. Washburn.

The major application of the system described herein is to high frequency signals or digital signals having fast-rise and fast-fall times and wherein it is important that the integrity of these signals be maintained when they are transmitted over different switching paths and through differently routed transmission lines.

The above described systems which, in one case, provides a transmission line with integrated switches, and, in another case, permits simple and inexpensive relay switches embedded adjacently parallel to the ground plane of a printed circuit board and wherein each of the individual relay switches have a dual grounded shield at each end to provide a tree structure such that, no matter what configuration of switches is used, each transmission line path that is routed will provide the proper constant-impedance distortion-free transmission line which will transmit high-frequency signals without distortion over paths which may vary in length or in configuration.

What is claimed is:

1. In a system for providing a constant impedance transmission line which is switchable from one input to a plurality of output points, the network comprising:

(a) an input signal line having a high side and a low side;

(b) first switching means including a movable contact and first and second stationary output contacts, said movable contact connected to said input line and actuatable to connect either one of said first or second stationary output contacts;

(c) a first and second output line connected to said first and second stationary output contacts;

(d) means to actuate said movable contact of said input line;

(e) sealing means encompassing said switching means;

(f) a circuit board of insulating layers sandwiching a ground plane connected to said low side at said signal input line;

(g) shielding means encompassing said switching means and including connection means to said ground plane;

(h) first and second transmission lines connecting the output contacts and output lines of said switching means to an input line of a second and of a third switching means, said first and second transmission lines being of equal cross section and length and running parallel to said ground plane.

2. The network of claim 1, including:

(a) recess means in said circuit board for mounting each of said switching means parallel and adjacent to said ground plane.

3. The network of claim 1, wherein said shielding means includes: a cylindrical electromagnetic shield having an input end and an output end; a first connection means from said input end to said ground plane; a second connection means from said ouput end to said ground plane.

4. The network of claim 3, including a subsequent group of switching means having input lines connected from the output lines of prior switching means and wherein the transmission lines, connecting each prior group of switching means to a subsequent group of switching means, are of equal cross section and equal length and form a symmetrical configuration parallel to said ground plane.

5. In a switching network for providing a high frequency transmission line whose input may be routed into a plurality of different output paths, the network including:

(a) a printed circuit board having an interior ground plane and a surface plane with hollow recesses for mounting of reed relay switches;

(b) a plurality of sealed reed relay switches mounted in said recesses wherein each relay switch includes a movable input arm and two stationary output arm connections, said input and output arms lying parallel to said ground plane;

(c) transmission line strips on said printed circuit board for connecting each of the output arms of any one relay switch to the input arms of a first and second subsequent relay switch, each of said transmission line strips conforming in size, shape and length to the other;

(d) each of said relay switches being hermetically sealed and situated parallel and closely adjacent to said ground plane;

(e) means for actuating the said movable arm of each relay in order to establish contact with one or the other of its output arms;

(f) electromagnetic shielding means encompassing each relay switch, said shielding means connected to the ground plane area closest to each end of said shielding means.

6. The network of claim 5, including a further plurality of said relay switches parallel to the same ground plane and forming a tree configuration to permit one input signal line to be selectively connected to any one of a plurality of output lines while maintaining the same transmission line impedance for any switching configuration.

7. In a high frequency transmission line which maintains a constant impedance and which can be routed to selected output paths, the apparatus comprising:

(a) a circuit board including an upper and lower insulated surface having a metallic ground plane therebetween;

(b) a first transmission line for carrying an input signal;

(c) a "zero" level switching means connected to said first transmission line, said switching means including:

(c1) a reed relay switch situated parallel to said ground plane and including:

(c1a) an input line and two output lines;

(c1b) movable contact means for connecting said input line to either one of said two output lines;

(c1c) sealing means hermetically sealing said input and output lines and said movable contact means;

(d) an electromagnetic shield encompassing said first level switching means and connected to said ground plane;

(e) actuating means for controlling the movement of said movable contact means;

(f) first and second transmission lines on said circuit board running parallel to said ground plane connected to the two output lines of said first switch.

8. The apparatus of claim 7 including:

(h) a "first" level switching means including a second and third switch as in clauses (c1a), (c1b), (c1c), (d) and (e) wherein the output lines of said first switch connect respectively to the input lines of said second and third switches;

(i) and wherein said transmission output lines of said first switch include first and second printed strip transmission lines on said circuit board, said first and second printed strips being duplicates of each other in size, shape and electrical characteristics.

9. The apparatus of claim 8, wherein each connection between each electromagnetic shield and said ground plane is accomplished directly at each end of said electromagnetic shield.

10. The apparatus of claim 8, including:

(j) "n" level switching means including $2^n$ switches, said switches connected to form a tree structure and wherein each switch includes the elements of clauses (c1a), (c1b), (d) and (e);

and wherein selective actuation of said switches will provide a transmission line from an input signal to any selected one output of a plurality of outputs.

11. A high frequency transmission line which maintains a constant impedance while being switched and routed through a plurality of different channels, the network comprising:

(a) a coaxial input line of a specified characteristic impedance having a high side and a low side;

(b) a single pole double-throw sealed reed relay switch having an input connected to the high side of said input coaxial line and having two outputs;

(c) a first and second coaxial output line respectively connecting to the first and second output lines of said switch, each of said first and second coaxial lines having their low sides connected together;

(d) electromagnetic shielding means encompassing said reed relay switch and connected to the low side of said input coaxial line and also connected to the low side of said first and second coaxial output lines;

(e) activation means for changing the high side input of said relay switch from one output line to the other.

12. The network of claim 11 wherein each of said output lines of said relay switch becomes a new coaxial input line having appended to it the elements of clauses (b), (c), (d) and (e) to form a tree configuration and wherein each switch and coaxial line has an impedance matching the impedance of each other switch and line in the network.

* * * * *